US005591064A

United States Patent [19]

Spears, Jr.

[11] Patent Number: 5,591,064

[45] Date of Patent: Jan. 7, 1997

[54] BLASTING APPARATUS AND METHOD FOR BLAST CLEANING A SOLID SURFACE

[75] Inventor: William E. Spears, Jr., Lawrenceville, N.J.

[73] Assignee: Church & Dwight Co., Inc., Princeton, N.J.

[21] Appl. No.: 497,106

[22] Filed: Jun. 30, 1995

[51] Int. Cl.[6] ..... B24C 3/00

[52] U.S. Cl. ..... 451/2; 451/39; 451/100; 451/446

[58] Field of Search ..... 451/2, 3, 38, 39, 451/100, 446

[56] References Cited

U.S. PATENT DOCUMENTS

| | | | |
|---|---|---|---|
| 2,661,537 | 12/1953 | Angell . | |
| 2,969,049 | 1/1961 | Dillenberg . | |
| 3,971,375 | 7/1976 | Hill . | |
| 4,276,023 | 6/1981 | Phillips et al. | 433/85 |
| 4,492,575 | 1/1985 | Mabille | 433/88 |
| 4,494,932 | 1/1985 | Rzewinski | 433/88 |
| 4,614,100 | 9/1986 | Green et al. | 451/2 X |
| 4,635,897 | 1/1987 | Gallant | 251/5 |
| 4,708,534 | 11/1987 | Gallant | 406/75 |
| 4,767,404 | 8/1988 | Renton | 604/48 |
| 4,826,431 | 5/1989 | Fujimura et al. | 433/29 |
| 4,893,440 | 1/1990 | Gallant et al. . | |
| 5,081,799 | 1/1992 | Kirschner et al. . | |
| 5,083,402 | 1/1992 | Kirschner et al. . | |
| 5,109,637 | 5/1992 | Calafut . | |
| 5,334,019 | 8/1994 | Goldsmith et al. | 433/88 |

FOREIGN PATENT DOCUMENTS

| | | | |
|---|---|---|---|
| 2724318 | 11/1978 | Germany | 451/100 |

*Primary Examiner*—Timothy V. Eley
*Attorney, Agent, or Firm*—Irving Fishman

[57] ABSTRACT

Blast cleaning with at least two types of abrasives employing a blasting apparatus having at least a first and a second closed blasting pot connected to a conveying line and the conveying line and each blasting pot are connected to a source of compressed gas by a differential pressure metering system. The differential pressure metering system provides a differential pressure between each blasting pot and the conveying line enabling blasting media in each pot to pass from each pot through a variable size orifice to the conveying line. Each blasting pot can be operated independently of each other enabling varying proportions of different types of blast media to be released in the conveying line and blasted from a nozzle to clean a solid surface.

36 Claims, 2 Drawing Sheets

BLASTING APPARATUS AND METHOD FOR BLAST CLEANING A SOLID SURFACE

BACKGROUND OF THE INVENTION

The present invention is directed to blast cleaning with abrasives. More specifically, the present invention is directed to an improved apparatus for blast cleaning with at least two different types of abrasives.

In order to clean a solid surface to preserve metal against deterioration, remove graffiti from stone or simply to degrease or remove dirt or other coatings from a solid surface, it has become common practice to use an abrasive blasting technique wherein abrasive particles are propelled by a fluid against the solid surface in order to dislodge the previously applied coatings, scale, dirt, grease or other contaminants. Such abrasive blasting has been used favorably, for example, to degrease metal and is increasingly replacing the environmentally hazardous solvent cleaning treatments.

Standard sand blasting equipment consists of a pressure vessel or blasting pot to hold particles of a blasting medium such as sand, connected to a source of compressed air by means of a hose and having a means of metering the blasting medium from the blast pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 20–30 lbs/min. About 1.2 lbs of sand are used typically with about 1.0 lb of air, thus yielding a ratio of 1.20.

When it is required to remove coatings such as paint or to clean relatively soft surfaces such as aluminum, magnesium, plastic composites and the like, less aggressive abrasives, including inorganic salts such as sodium bicarbonate and sodium chloride, can be used in conventional sand blasting equipment. The medium flow rates required for less aggressive abrasives are substantially less than that used for sand blasting, and have been determined to be from about 0.5 to about 10.0 lbs/min., using similar equipment. This requires a much lower medium to air ratio, in the range of about 0.05 to 0.25.

However, difficulties are encountered in maintaining continuous flow at these low flow rates when conventional sand blasting equipment is employed. Fine particles of a medium such as sodium bicarbonate are difficult to convey by pneumatic systems by their very nature. Further, they tend to agglomerate upon exposure to a moisture-containing atmosphere, as is typical of the compressed air used in sand blasting. Flow aids such as hydrophobic silica have been added to the bicarbonate in an effort to improve the flow, but maintaining a substantially uniform flow of bicarbonate material to the nozzle has been difficult to achieve. Sporadic flow of the blasting media leads to erratic performance which in turn results in increased cleaning time and even to damage of somewhat delicate surfaces.

Commonly assigned U.S. Pat. Nos. 5,081,799 and 5,083,402 disclose a modification of conventional blasting apparatus for directing the less aggressive abrasives to a substrate surface by providing a separate source of line air to a closed supply pot through a pressure regulator to provide a greater pressure in the supply pot than is provided to the conveying hose. This differential pressure is maintained by an orifice having a predetermined area and situated between the supply pot and the conveying hose. The orifice provides an exit for the blast media and a relatively small quantity of air from the supply pot to the conveying hose, and ultimately to the nozzle and finally to a workpiece. The differential air pressure, typically operating between 1.0 and 5.0 psi with an orifice having an appropriate area, provides accurate control over media flow rates. An example of such a system is the Accustrip System™ developed by Church & Dwight of Princeton, N.J. The blasting apparatus disclosed in U.S. Pat. Nos. 5,081,799 and 5,083,402 are a significant improvement over standard sand blasting equipment, especially for blasting with less aggressive abrasive media.

Suitable abrasive materials which can be used to clean solid surfaces with a blasting apparatus such as the Accustrip System™ include, but are not limited to, such materials as sodium bicarbonate, sodium chloride, aluminum oxide, magnesium oxide, sand, and the like as well as mixtures thereof. Any type of abrasive having a Mohs hardness of up to about 10 can be blasted from such apparatus. Other cleaning adjuvants which can be mixed with abrasives or separately blasted at a workpiece include, but are not limited to, such materials as surfactants, sanitizing agents, and corrosion inhibitors in solid form or in liquid form applied separate from the abrasive as in a pressurized liquid stream or sprayed onto the abrasive particles or inert carriers.

Blasting apparatus such as the Accustrip System™ are a very effective blasting apparatus for cleaning all solid surfaces including relatively soft solid surfaces such as aluminum, magnesium, plastic composites, and the like. Such blasting apparatus as the Accustrip System™ can blast clean with one type of abrasive or a combination of abrasives and/or adjuvants at the same time. However, if such systems blast clean with more than one type of abrasive, the abrasives and, if used, other cleaning adjuvants are premixed in a desired proportion then prepacked before arriving at the blasting site, or are premixed at the site before placing the abrasive mixture in the blasting pot of the apparatus. Abrasive mixtures having the desired proportions of each abrasive or adjuvant are expelled from a nozzle orifice toward a workpiece to be cleaned.

Often the nature of the substrate being blast cleaned can vary drastically from area to area. Thus, there is a need for using different types of abrasives or cleaning adjuvants. While a premixed abrasive can be beneficial in tailoring the blast cleaning operation to improve the removal of specific contaminants which may predominate on the substrate being cleaned, it still would be worthwhile to provide the operator more flexibility during the blasting process to choose which particular abrasive and/or cleaning adjuvant to use to increase blasting productivity and as will conserve materials to improve overall processing efficiency.

U.S. Pat. No. 5,334,019 discloses a dental apparatus for cleaning teeth employing two hoppers for introducing abrasive material into a flexible hose with a gas flow stream. Different sized and/or types of particles can be contained within each separate hopper. A control system is employed to introduce abrasive material from either or both hoppers into the gas flow stream. Such a system is specifically employed for removing and/or cutting tooth structures of enamel and dentin and for removing amalgam, composites, other dental tooth filling materials and/or stain.

Each hopper of the dental apparatus is connected by feed valves to a mixing chamber which interrupts media flow from each hopper to the gas stream in the flexible hose. It is in the mixing chamber where abrasive materials are mixed prior to passing to the gas stream in the flexible hose. Alternatively, the mixing chamber can be eliminated and lines from each hopper are joined at a Y junction where abrasive materials from each hopper can be introduced to a gas stream directly. The Y junction has a flapper valve which allows an operator to alternate from one abrasive material to another. A disadvantage of such an apparatus having added mechanical components in flow lines is a potential for residual build up of abrasive material at junctions where flow lines and mechanical components meet resulting in blockage at the junctions, especially if such apparatus are not properly maintained. Moreover, mechanical components wear out with continued use and must be replaced. Thus, the more mechanical components an apparatus has the costlier it is to maintain and less desirable for a relevant industry to employ.

Although there are effective blasting apparatus for cleaning solid surfaces, a primary object of the present invention is to provide for an improved apparatus and method for blast cleaning a solid surface with at least two different abrasives and/or adjuvants and which allows for continued and immediate changes in the proportions of the individual abrasives directed from the blast nozzle, and, thus, provide an operator with greater flexibility during the blast cleaning operation.

Another object is to provide for a blasting apparatus which provides for blast cleaning with at least two different abrasives and/or adjuvants, which provides for precise control over the relative proportions of the separate media directed from the nozzle and which maintains a continuous flow rate of each blasting media to the nozzle.

A further object is to provide a blasting apparatus for blast cleaning with at least two different abrasives and/or cleaning adjuvants contained in separate blasting pots where each blasting pot of the apparatus can be operated independently of each other.

Still yet another object of the present invention is to blast clean a solid surface with at least two abrasives having a different Mohs hardness and/or particle size where the flow rate of the individual abrasive can be independently controlled.

Additional objects, advantages and novel features of the invention will be set forth in part in the description which follows, and in part will become apparent to those skilled in the art upon examination of the following description or may be learned by practice of the invention.

SUMMARY OF THE INVENTION

The present invention provides a blasting apparatus which can clean a solid surface employing at least two different abrasives and/or adjuvants. The blasting apparatus has at least two blasting pots where each pot can contain a different type of abrasive and/or adjuvant. Each blasting pot can be operated independently of each other such that an operator can control the precise proportions of each abrasive and/or adjuvant mixed in a gas stream in a conveying line to be expelled from a nozzle toward a solid surface. Advantageously, the apparatus of the present invention eliminates the steps of weighing out, mixing and packaging each type of abrasive in desired proportions prior to introducing abrasive mixtures to a blasting apparatus at a blast cleaning site and provides the operator greater flexibility during the blast cleaning process to meet changing surface conditions.

The blasting apparatus of the present invention is based on the Accustrip™ system and provides accurate control of abrasive proportions in the blast stream by using a differential pressure metering system between each blasting pot and the pressurized conveying line wherein the pressure in each blasting pot is greater than in the conveying line, thus allowing abrasive material to pass from each pot and mix in the conveying line with the stream of compressed gas. Advantageously, the abrasives are directed from the blasting pots and mixed with compressed gas in the conveying line and discharged at a nozzle without any mechanical obstructions in the conveying line such as mixing chambers or flapper valves which could lead to obstruction of abrasive flow to the nozzle, thus reducing the efficiency of the apparatus. The differential pressure metering system includes a pressure regulator means which allows precise control of the differential pressure between each blasting pot and the conveying line. A variable size orifice having different diameters and aligned with the exit line from each blasting pot allows media particles to be precisely metered from each blasting pot and increases the control of the media flow rates from each blasting pot to the conveying line and the media flow rates of each abrasive or adjuvant relative to the other.

DETAILED DESCRIPTION OF THE INVENTION

Figure 2:
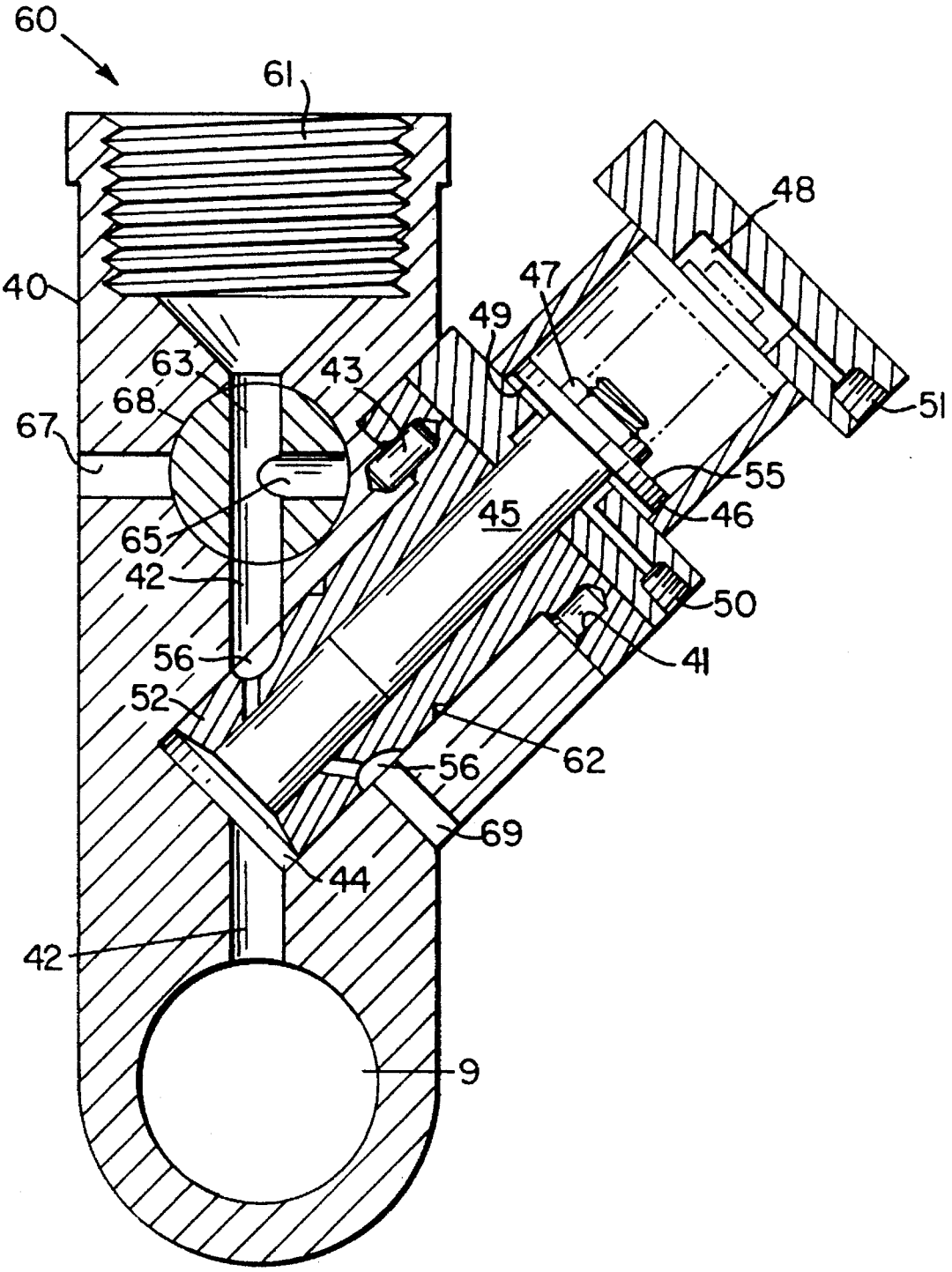
FIG. 2 is a cross sectional view of a media control valve used in the blasting apparatus.

The present invention is directed to blast cleaning a solid surface with at least two types of abrasives. The apparatus of the present invention comprises at least a first and a second blasting pot each with a lid; however as many as 3 or more blasting pots can be employed to practice this invention. Each blasting pot is connected to a common conveying line by its own exit line extending from a bottom of each pot. Each exit line has a media control valve which regulates the flow of blasting media from a blasting pot via a variable size orifice. The variable size orifice of the present invention can be part of the media control valve as illustrated in FIG. 2 or separate from the media valve in the form of an orifice plate placed in the exit line between the conveying line and the valve.

A differential pressure metering system connects each blasting pot and the conveying line to the blast nozzle to a source of compressed gas which typically is air. The differential pressure metering system provides a differential pressure across the orifice and, thus, between each blasting pot and the conveying line where the pressure is higher in each blasting pot and lower in the conveying line, thus allowing blasting media to pass from the blasting pot into the conveying line. Thus, blasting media from each blasting pot are mixed with the compressed gas in the conveying line, and the mixture is discharged from a nozzle at an end of the conveying line to clean a solid surface.

According to the present invention, a differential pressure gauge can be installed between the conveying line and each blasting pot or between an exit line and the conveying line to monitor the differential pressure directly. Pressures can be precisely controlled by means of a pressure regulator at any conveying line pressure of from about 10 to about 125 psig or higher, depending on the supply of air pressure. The present invention eliminates this source of flow rate variation and also modifies conventional equipment to handle blast media at flow rates of from about 0.5 to about 20 lbs/min., preferably from about 0.5 to about 5 lbs/min, most preferably from about 1 to about 3 lbs/min.

Figure 1:
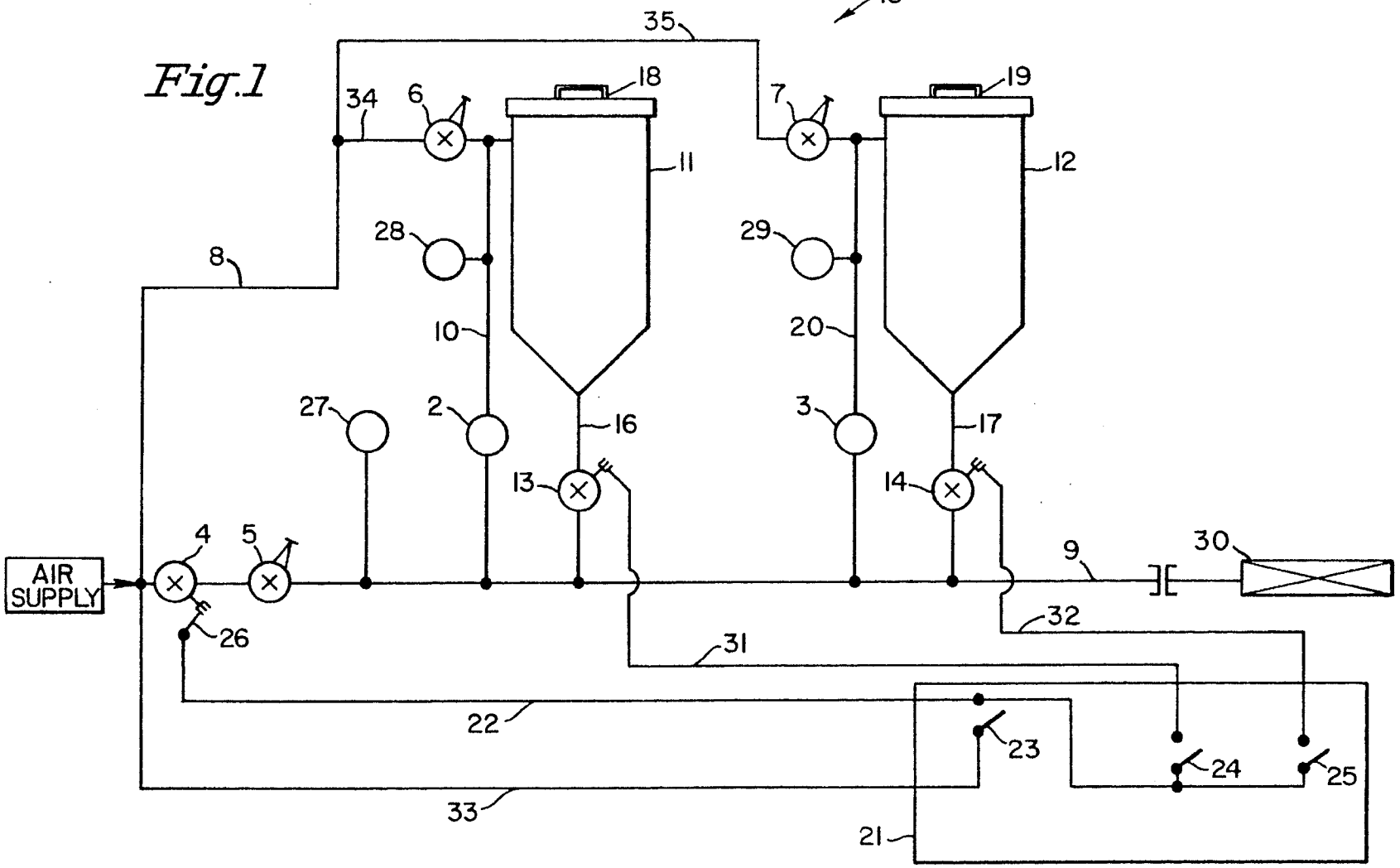
FIG. 1 is a schematic view of the blasting apparatus of the present invention.

FIG.1 discloses one embodiment of the present invention and is not intended to limit its scope. Blasting apparatus 15 includes blasting pots 11 and 12 with covers 18 and 19, respectively. Each blasting pot can contain a different type of abrasive material and/or adjuvant. Each blasting pot has a cavity of about 4 cubic feet to about 10 cubic feet, preferably about 6 cubic feet. Blasting pots 11 and 12 terminate in exit lines 16 and 17, respectively, governed by media control valves 13 and 14, respectively, each of which has a variable size orifice (not shown). Exit lines 16 and 17 communicate with conveying line 9, and conveying line 9 communicates with a source of pressurized gas (not shown). Compressed gas from the compressed gas source passes through line 8 to lines 34 and 35 pressurizing blasting pots 11 and 12, respectively. Air valve 4 is a remotely operated on/off valve for release of compressed gas into conveying line 9 and controlled by pneumatic control circuit 21 through pneumatic line 22 and air control valve 26 by means of an on/off deadman 23. Blast pressure regulator valve 5 regulates nozzle pressure at nozzle 30. The pressure can be monitored by means of gauge 27 when the system is in operation. Gauge 27 measures a controlled pressure to be applied to nozzle 30 which is a conventional nozzle. The differential pressure gauges 2 and 3 connected to pressure gauge lines 10 and 20, respectively, monitor differential pressure between blasting pots 11 and 12, respectively, and conveying line 9. Blasting pot pressures are measured by gauges 28 and 29 and blasting pot regulators 6 and 7 of blasting pots 11 and 12, respectively, provide and regulate the pressure to a level higher than the pressure in conveying line 9, thus allowing the differential pressure to be monitored by differential pressure gauges 2 and 3 of blasting pots 11 and 12, respectively. Optional equipment for protection of and cooling of the workpiece and control of dust is provided by a water injection line in the nozzle (not shown).

In operation, an operator manually closes deadman 23 which utilizes compressed gas from a compressed gas source through line 33 to create a compressed gas stream in line 22 which activates air control valve 26 and air valve 4 allowing the compressed gas stream into conveying line 9. Simultaneously, compressed gas passes through line 8 and then into lines 34 and 35 which are in communication with line 8 to pressurize blasting pots 11 and 12, respectively. Blasting pots 11 and 12 can be operated independently of each other by means of pneumatic circuit 21 via valves 24 and 25. Thus, valve 24 and/or valve 25 of pneumatic circuit 21 can be opened opening media control valves 13 and/or 14 through pneumatic lines 31 and 32, respectively, thus allowing blasting media to pass through variable size orifices (not shown) within the media control valves which regulate the flow of media through exit lines 16 and 17 to conveying line 9. Variable size orifice openings from about 0.063 to about 0.187 inches in diameter to as large as about 0.231 inches in diameter allow blast media to pass into the conveying line. Preferably openings correspond to about 0.187 inches in diameter for sodium bicarbonate media having a mean particle size of about 50 to about 1000 microns, and about 0.125 inches in diameter for aluminum oxide media having a mean particle size of about 50 to about 300 microns. A positive pressure of between about 0.5 to about 10 psig, preferably about 1 to about 5 psig, between blasting pots 11 and 12 and conveying line 9 is maintained during operation. A source of compressed gas is fed to conveying line 9, regulated by valve 5 to a desired air pressure and subsequent nozzle pressure which preferably are between about 15 to about 125 psig. Blasting pot regulators 6 and 7 control pressure to blasting pots 11 and 12, respectively. The differential pressure gauges 2 and 3 measure the differential pressure between blasting pots 11 and 12, respectively, and conveying line 9 which is proportional to the amount of blasting media flowing through variable size orifices in media control valves 13 and 14. Blast media, compressed gas and water are delivered to nozzle 30 and ejected toward a solid surface (not shown) at a uniform and controllable rate.

Abrasives which can be employed to practice this invention include soft abrasives having a Mohs hardness of from about 1 to about 5. Such abrasives include, but are not limited to, sodium bicarbonate, potassium bicarbonate, ammonium bicarbonate, sodium chloride, and the like. Harder abrasives having a Mohs hardness of from about 6 to about 10 also can be employed. Such abrasives include, but are not limited to, aluminum oxide, magnesium oxide, sand, and the like. Other materials which can be employed in the blasting apparatus of the present invention include, but are not limited to, adjuvants such as surfactants, sanitizing agents, corrosion inhibitors in solid or liquid form sprayed onto inert carriers and the like.

Advantageously, each blasting pot can be operated independently of each other by means of media control valves for precise control of amounts and types of media mixed in the conveying line and blasted from a nozzle. Thus, each blasting pot can comprise blasting media having a different Mohs hardness and/or particle size, or each blasting pot can have blasting media having the same particle size and/or Mohs hardness, depending upon the type and condition of surface to be cleaned, and desired amounts of each medium can be mixed in the conveying line and blasted from a nozzle to clean a solid surface. Consequently, the present invention allows a desired set of abrasives to be at the work site to allow an operator total flexibility to immediately mix and match the abrasives at the nozzle to meet varying surface conditions on the surface to be cleaned.

Adjuvants also can be mixed with abrasive media in varying amounts or placed in a blasting pot separate from an abrasive and mixed with an abrasive in the conveying line during operation of the apparatus. Variable amounts of each abrasive and adjuvant can be mixed in varying proportions in the conveying line and discharged at the nozzle. Media valves and air valves can be operated manually, pneumatically or electrically actuated, and are controlled by a deadman control system as employed in the art. The apparatus of the present invention can be used efficiently and controllably with robotics.

When sodium bicarbonate and aluminum oxide are employed as abrasives to clean a solid surface, the ratio of sodium bicarbonate to aluminum oxide ranges from about 1:1 to about 5:1 by weight, preferably from about 3:1 to about 4:1. If sodium bicarbonate and magnesium oxide are employed, the ratio of sodium bicarbonate to magnesium oxide ranges from about 2:1 to about 4:1, preferably about 3:1. The specific proportions of one abrasive to a second depends on the surface to be cleaned. Appropriate proportions of each abrasive to clean a particular surface are well known to those of skill in the art.

The present invention can employ any media control valve having a variable size orifice for release of blast media. FIG. 2 discloses one type of media control valve having a variable size orifice which can be employed to practice this invention. Another type of media control valve which can be employed to practice this invention is disclosed in U.S. patent application Ser. No. 08/161,530 assigned to Church & Dwight and allowed 02/17/95, the entire disclosure which is hereby incorporated herein in its entirety by reference. Each exit line of blasting pots 11 and 12 can contain a media control valve 60 which includes a valve body 40 which communicates with blasting pots 11 and 12, see FIG. 1. Each exit line extends down and joins with inlet 61 of a media passage within valve body 40 and continues as vertical discharge tube 42 within valve body 40. Discharge tube 42 communicates with a downstream horizontal conveying line 9 also formed as part of valve body 40. Conveying line 9 is disposed substantially perpendicular to the vertical discharge tube 42 and communicates therewith, except for when a valve stem 45 is positioned to close the valve and prevent media flow therethrough. Valve stem 45 is placed within a bore 44 contained in valve body 40. Bore 44 preferably is disposed at an acute angle from vertical or is inclined with respect to the discharge tube 42. The amount of angle is not critical and can be from about 20° to 90° from vertical. Valve stem 45 is movable within bore 44 to close discharge tube 42 and completely seal off and prevent any of the abrasive or air pressure within a blasting pot from passing into the conveying line.

A piston 46 is connected to, or is formed integrally with valve stem 45. Piston 46 can be threaded onto valve stem 45 and secured in place by lock nut 47. Piston 46 is placed in sealing engagement with the inside surface of pneumatic chamber 48 which is separate from valve body 40. The lower surface 49 of piston 46 is in communication with gas pressure supplied from the gas pressure source (not shown) to conveying line 9 by means of a connecting pressure supply tube 50. Accordingly, compressed gas applied to conveying line 9 also is applied to the lower surface 49 of piston 46 to move piston 46 and attached valve stem 45 upward and out of discharge tube 42. Valve stem 45 can be returned to the closed position when the gas pressure on the lower surface 49 of piston 46 is reduced or eliminated and compressed gas is provided via valve supply tube 51 to the top surface 55 of piston 46 in chamber 48 to lower valve stem 45.

Preferably, valve stem 45 does not act to meter the amount of abrasive media flowing through discharge tube 42 into conveying line 9. Instead, valve stem 45 is an on-off valve which when retracted will allow free passage of the media through discharge tube 42 into conveying line 9 and when closed will stop all passage of the media therethrough. Valve stem 45 is slidable in a media control sleeve 52 which is placed within bore 44. Media control sleeve 52 contains a plurality of spaced orifices 56 of varying diameter and which can be placed into communication with discharge tube 42 and conveying line 9 to allow passage of the media therethrough when valve stem 45 is in the open position and displaced from the discharge tube 42.

Media control valve 60 allows media control sleeve 52 to be rotated while in place within bore 44 of valve body 40 so as to place one of the different orifices 56 in communication with discharge tube 42 and conveying line 9. Media control sleeve 52 is locked in place when hole 41 in the flange end of sleeve 52 meets pin 43. In some devices, the valve body 40 has to be disassembled, the control sleeve removed entirely from the valve body, and rotated to align the desired orifice with the discharge tube and then returned to the valve body which was then reassembled. In this particular valve, control sleeve 52 is manually rotatable in place within bore 44 and an index means is provided to align an orifice 56 with discharge tube 42 and to indicate to the user that the proper alignment has been made. As an example, the media control sleeve 52 can contain four orifices having, but not limited to, a size of 0.125, 0.156, 0.187, and 0.209 inches in diameter. The exact size of the orifices is not critical to the present invention and the listed sizes are for illustrative purposes only.

Media control valve 60 also contains a multi-orifice ball or plug valve 68 which is placed intermediate to inlet 61 of discharge tube 42 and the media control sleeve 52 and can be rotated manually via a handle (not shown) to index the desired orifice or passageway therethrough. The valve 68 includes a diametrically placed passage 63 and a radially directed passage 65 which communicates with the center of diametric passage 63. In operation, when abrasive media is to be entrained within the compressed air stream, the valve 68 is turned so that diametric passage 63 is disposed vertically and communicates with the inlet 61 of discharge tube 42 and the lower portion of discharge tube 42 to allow media flow from inlet 61 through passage 63 in valve 68 and into the lower portion of discharge tube 42, through one of the orifices 56 in media control sleeve 52 and then into the conveying line 9. Valve 60 also includes a means to clean out the discharge tube 42. In the clean out operation, valve 68 can be rotated so that the diametric passage 63 no longer communicates with the inlet 61 of discharge tube 42 but instead, is disposed horizontally and placed in communication with a clean out exit port 67 placed in valve body 40. Radial passage 65 is disposed vertically and placed in communication with the lower part of discharge tube 42. To clean discharge tube 42, valve stem 45 is disengaged from discharge tube 42 by action of pneumatic piston 46, compressed air is either passed up through conveying line 9 or through clean out inlet port 69 which communicates with bore 44 and the interior of sleeve 52 to allow back-cleaning of the discharge tube. Any debris is discharged through outlet port 67 via radial passage 65 and diametric passage 63.

In the use or operation of the media valve 60 in combination with blasting pots 11 and 12, pots 11 and 12 are filled, or partially filled, with abrasive. After the abrasives are within each pot the apparatus is pulled or is otherwise moved to the location for the blast cleaning operation. Blasting pots 11 and 12 then are connected to a suitable source of compressed gas. The compressed gas pressurizes pots 11 and 12 and also can be used to supply the gas pressure to the air flow tube 9 and air supply tube 50 of each valve 60. Thus, pots 11 and 12 are pressurized and each valve 60 is automatically opened by displacement of valve stem 45 from discharge tube 42 substantially simultaneously. This results in a pressurized flow of each abrasive downwardly through the vertical discharge tube 42, through one of orifices 56 in control sleeve 52 and into the conveying line 9. The pressure within the conveying line 9 acts to force abrasive outwardly to where the conveying line terminates with a suitable nozzle. Nozzle sizes typically range from about ⅛ to about ½ inch in diameter at the nozzle orifice. The structure of the surface to be cleaned can vary widely and is unlimited. Thus, the surface can be a part of complex configuration, sheeting, coils, rolls, bars, rods, plates, discs, pipes, tubes, etc. Such articles can be derived from any source including for home use, industrial use such as from the aerospace industry, automotive industry or the electric industry, etc.

The type of contaminant which can be removed from the substrates using the process of this invention is unlimited. In general, the process of this invention can be used to remove all types of contaminants including paint, rust, scale, greases, cutting fluids, drawing fluids, machine oils, anti-rust oils such as cosmolene, carbonaceous soils, sebaceous oils, particulate matter, waxes, paraffins, used in motor oil, fuels, etc.

EXAMPLE

A blasting apparatus as disclosed in FIG. 1 is employed to clean aluminum panels. One blasting pot contains about 125 lbs of sodium bicarbonate and a second blasting pot contains about 125 lbs of aluminum oxide. The variable size orifice in the exit line of the first pot is set at a diameter of 0.187 inches and the variable size orifice in the exit line of the second pot is set at a diameter of 0.125 inches. Media control valves to the blasting pots are opened pneumatically such that the weight ratio of sodium bicarbonate to aluminum oxide mixing in the conveying line is about 4:1 by weight. A gas stream is generated in the conveying line by a compressed gas source employed in the industry and well known to those of skill in the art. The stream of gas is mixed with the abrasives, and the mixture of gas, sodium bicarbonate and aluminum oxide at a pressure of about 64 psig and flow rate of about 3 lbs/min., nozzle pressures of about 60 psig and water pressure of about 200 psi are directed at a surface to be decoated at a nozzle distance of 18 feet from the orifice of the nozzle at the end of the conveying line. The surface is decoated and all corrosion products removed.

What is claimed is:

1. A method of blast cleaning comprising the steps of:

a. containing a quantity of a first and a second blasting media in first and second blasting pots, respectively, wherein each blasting pot has a bottom with exit line in communication with a conveying line;

b. pressurizing each blasting pot and the conveying line to provide a differential pressure therebetween by a differential pressure metering system in communication with each blasting pot and the conveying line, wherein the differential pressure metering system joins each blasting pot and the conveying line to a source of pressurized gas;

c. feeding each blasting medium from each blasting pot through each exit line of each blasting pot to the conveying line, wherein each exit line has a variable size orifice for controlling flow of blasting media to the conveying line;

d. mixing blasting media with a stream of pressurized gas flowing within the conveying line at a uniform rate from the compressed gas source;

e. regulating the pressure in the pressure line and in the conveying line with a pressure regulator means to maintain a uniform differential pressure at a preselected level such that the pressure level within each pot is greater than the pressure within the conveying line;

f. sensing the pressure in each blasting pot and the conveying line with a sensor means connected to each blasting pot and conveying line for monitoring the differential pressure therebetween; and g. discharging the mixture of blasting media and the stream of pressurized gas through a nozzle at an end of the conveying line at a uniform flow rate to a solid surface.

2. The method of claim 1, wherein the mean particle size of the blasting media ranges from about 50 to about 1000 microns.

3. The method of claim 1, wherein the particle size of the blasting media ranges from about 50 to about 300 microns.

4. The method of claim 1, wherein the preselected differential pressure is between about 1.0 to about 5.0 psig.

5. The method of claim 1, wherein the preselected differential pressure is between about 0.5 to about 10.0 psig.

6. The method of claim 1, wherein the nozzle has a uniform flow rate of from about 0.5 to about 10 lbs/min.

7. The method of claim 1, wherein the nozzle has a uniform flow rate of from about 1 to about 3 lbs/min.

8. The method of claim 1, wherein the variable size orifice of each exit line has openings of from about 0.063 to about 0.231 inches in diameter.

9. The method of claim 1, wherein the variable size orifice of each exit line has openings of from about 0.063 to about 0.231 inches in diameter.

10. The method of claim 1, wherein at least one blasting media has a Mohs hardness of from about 1.0 to about 5.0.

11. The method of claim 10, wherein the blasting medium comprises sodium bicarbonate, potassium bicarbonate, ammonium bicarbonate or sodium chloride.

12. The method of claim 10, wherein at least one of the blasting media has a Mohs hardness greater than about 5.0.

13. The method of claim 12, wherein the blasting media comprises aluminum oxide, magnesium oxide or sand.

14. The method of claim 1, wherein the number of blasting pots ranges from 2 to 6.

15. The method of claim 1, wherein the differential pressure between the first blasting pot and the conveying line is different than the differential pressure between the second blasting pot and the conveying line.

16. The method of claim 15, wherein a ratio of a first blasting media to a second blasting media ranges from about 1:1 to about 5:1 by weight.

17. The method of claim 15, wherein a ratio of a first blasting media to a second blasting media ranges from about 1:1 to about 4:1 by weight.

18. The method of claim 1, further comprising a means for operating each blasting pot independently of one another.

19. The method of claim 1, wherein a media control valve in the exit line between the bottom of each blasting pot and variable size orifice controls flow of blasting media from each pot to the orifice.

20. The method of claim 1, wherein at least one blasting pot contains an adjuvant.

21. The method of claim 20, wherein the adjuvant comprises a surfactant, a sanitizing agent or a corrosion inhibitor in solid or liquid form.

22. The method of claim 1, wherein at least one blasting pot contains a mixture of an adjuvant with a blasting medium.

23. A blasting apparatus comprising: at least first and second closed blasting pots; conveying line between each blasting pot and a nozzle at an end of the conveying line; a source of compressed gas in communication with ends of each blasting pot and the conveying line; exit line extending from a bottom of each blasting pot to the conveying line, wherein each exit line has a variable size orifice for controlling flow of blasting media to the conveying line; a differential pressure metering system for providing a differential pressure between each blasting pot and the conveying line, wherein the differential metering system includes a pressure regulator means for regulating pressure within each blasting pot and the conveying line and for maintaining a positive, preselected differential pressure between each blasting pot and the conveying line; and a sensor means connected to each blasting pot and to the conveying line, for monitoring the differential pressure therebetween.

24. The blasting apparatus of claim 23, further comprising a means to independently open and close the exit lines of each blasting pot.

25. The blasting apparatus of claim 24, wherein each blasting pot can operate independently of each other.

26. The blasting apparatus of claim 23, wherein the pressure regulator means comprises a separate blasting pot pressure regulator means in connection with the differential pressure metering system and a separate conveying line pressure regulator means in connection with the conveying line.

27. The blasting apparatus of claim 26, wherein the blasting pot regulator means can be a manually, pneumatically, or electronically operated valve.

28. The blasting apparatus of claim 26, wherein the conveying line regulator means can be a manually, pneumatically, or electronically operated valve.

29. The blasting apparatus of claim 23, wherein the sensor means comprises a line having a blasting pot pressure gauge and a differential pressure gauge wherein the line is in communication with a blasting pot and the conveying line.

30. The blasting apparatus of claim 23, wherein the nozzle has a nozzle diameter of from about ⅛ to about ½ inch.

31. The blasting apparatus of claim 23, wherein the variable size orifice of each exit line has openings of from about 0.063 to about 0.231 inches.

32. The blasting apparatus of claim 23, wherein the variable size orifice of each exit line has openings of from about 0.063 to about 0.187 inches.

33. The blasting apparatus of claim 23, wherein the blasting apparatus comprises from 3 to 6 blasting pots.

34. The blasting apparatus of claim 23, wherein a media control valve in each exit line controls flow of blasting media from each blasting pot to the variable size orifice of each exit line.

35. The blasting apparatus of claim 34, wherein the variable size orifice of each exit line is part of the media control valve of each exit line.

36. The blasting apparatus of claim 35, wherein the media control valve comprises an index means by which to align the variable orifice to an orifice diameter.

* * * * *